US007101105B2

(12) United States Patent
Reggiani

(10) Patent No.: US 7,101,105 B2
(45) Date of Patent: Sep. 5, 2006

(54) CONTAINER-APPLICATOR FOR FLUID PRODUCTS, PARTICULARLY FOR COSMETIC AND PHARMACEUTICAL USE

(76) Inventor: Fulvio Reggiani, Via Boccaccio, 25, 21049 Tradate (IT)

( * ) Notice: Subject to any disclaimer, the term of this patent is extended or adjusted under 35 U.S.C. 154(b) by 0 days.

(21) Appl. No.: 10/459,522

(22) Filed: Jun. 12, 2003

(65) Prior Publication Data

US 2004/0071492 A1 Apr. 15, 2004

(30) Foreign Application Priority Data

Oct. 9, 2002 (IT) ..... MI2002A2143

(51) Int. Cl.
*B43K 5/00* (2006.01)

(52) U.S. Cl. ..... 401/205; 401/277

(58) Field of Classification Search ..... 401/196, 401/202, 204–207, 263–264, 277
See application file for complete search history.

(56) References Cited

U.S. PATENT DOCUMENTS 4,690,304 A * 9/1987 Morel ..... 222/44
4,909,265 A 3/1990 Goncalves
4,981,384 A * 1/1991 Kanou ..... 401/266
5,018,894 A 5/1991 Goncalves
5,026,193 A * 6/1991 Lucas ..... 401/277
6,682,246 B1 * 1/2004 Reggiani ..... 401/205

FOREIGN PATENT DOCUMENTS

| | | |
|---|---|---|
| DE | 82 19 090 | 9/1982 |
| FR | 1 420 454 | 12/1965 |
| FR | 2 663 300 | 12/1991 |
| FR | 2 681 050 | 3/1993 |

* cited by examiner

*Primary Examiner*—Tuan Nguyen
(74) *Attorney, Agent, or Firm*—Modiano & Associati; Albert Josif; Daniel J. O'Byrne

(57) ABSTRACT

A container-applicator for fluid products, for cosmetic and pharmaceutical use, comprising, at the mouth of a container, an applicator provided with a spongy-matrix body that is arranged proximate to an opening controlled by a valve element that can be operated from the outside of the container body, the valve element comprising a cap body that can be actuated rotationally in order to pass from a closed position to an open position of the opening and/or vice versa.

8 Claims, 3 Drawing Sheets

CONTAINER-APPLICATOR FOR FLUID PRODUCTS, PARTICULARLY FOR COSMETIC AND PHARMACEUTICAL USE

BACKGROUND OF THE INVENTION

The present invention relates to a container-applicator for fluid products, particularly for cosmetic and pharmaceutical use.

U.S. Ser. No. 10/184,975 by the same Applicant, assumed included herein by reference, discloses a container-applicator for fluid products that is generally constituted by a spongy-matrix body arranged proximate to the opening for connection to the inside of a container body.

The fluid product is dispensed by acting on the valve element that controls such opening, which can be operated from the outside of the container body, by way of a pressure to be applied to the spongy body, so as to overcome the elastic contrast and accordingly obtain the intended dispensing of the product.

This embodiment has proved to be valid in many respects but has been also found to be susceptible of improvements, especially as regards the type of actuation of the valve element, introducing a new solution that does not require to apply pressure to the spongy body, such pressure in some cases not being pleasant for the user.

SUMMARY OF THE INVENTION

The aim of the invention is to improve the use of the product, by providing a container-applicator in which the product is dispensed without having to compress the spongy body.

Within this aim, an object of the invention is to provide a container-applicator in which it is possible to perform a controlled dosage of the product that can be obtained in a particularly simple manner.

Another object of the present invention is to provide a container-applicator that can be operated rapidly and is further structurally very simple.

This aim and these and other objects that will become better apparent hereinafter are achieved by a container-applicator for fluid products, particularly for cosmetic and pharmaceutical use, according to the invention, which comprises, at the mouth of a container, an applicator provided with a spongy-matrix body that is arranged proximate to an opening controlled by a valve element that can be operated from the outside of the container body, characterized in that said valve element comprises a cap-like body that can be actuated rotationally in order to pass from a closed position to an open position of said opening and/or viceversa.

BRIEF DESCRIPTION OF THE DRAWINGS

Further characteristics and advantages of the invention will become better apparent from the description of a preferred but not exclusive embodiment of a container-applicator for fluid products, particularly for cosmetic and pharmaceutical use, illustrated by way of non-limitative example in the accompanying drawings, wherein.

DESCRIPTION OF THE PREFERRED EMBODIMENTS

Figure 1:
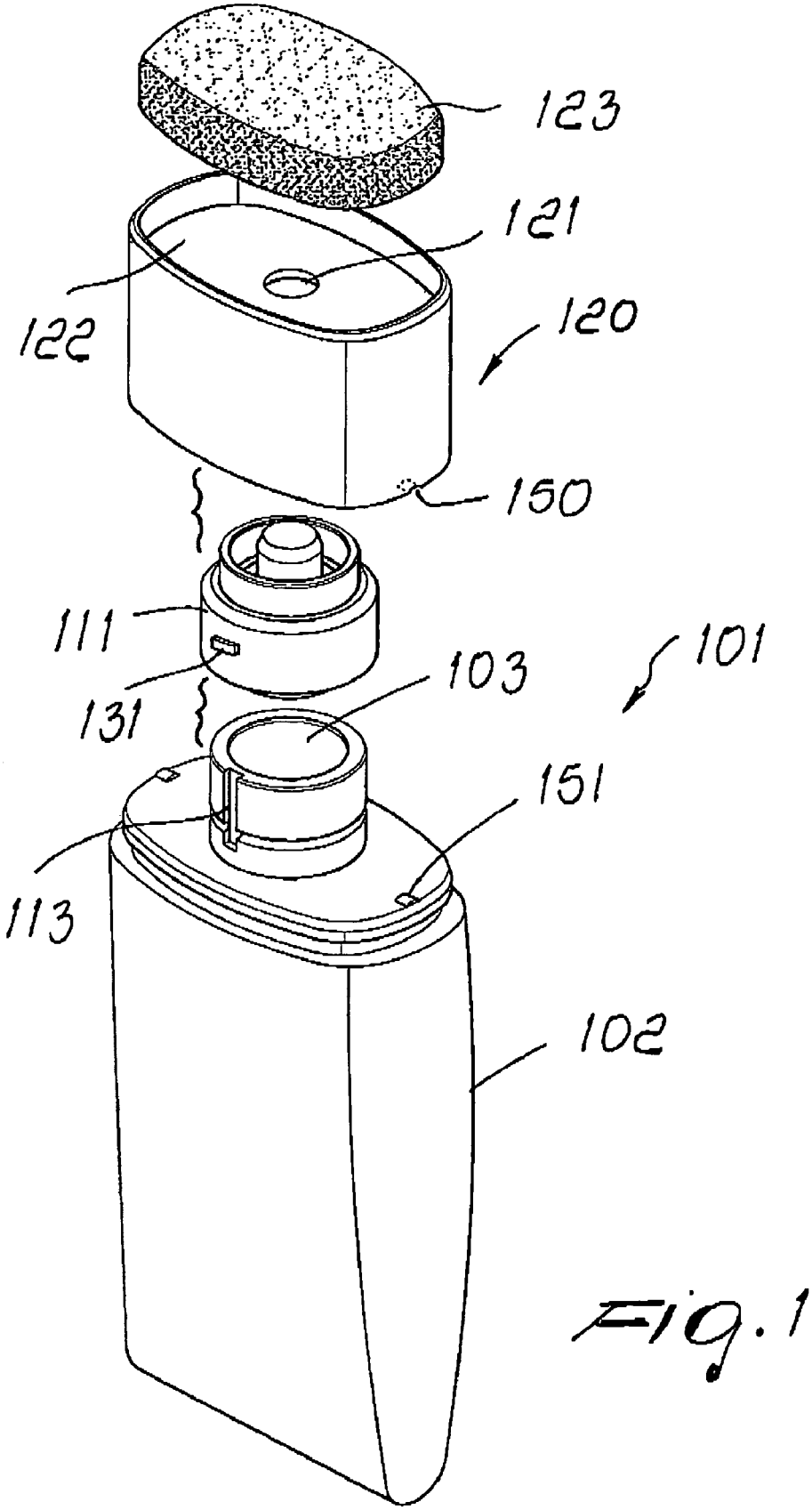
FIG. 1 is an exploded perspective view of the container-applicator.
Figure 3:
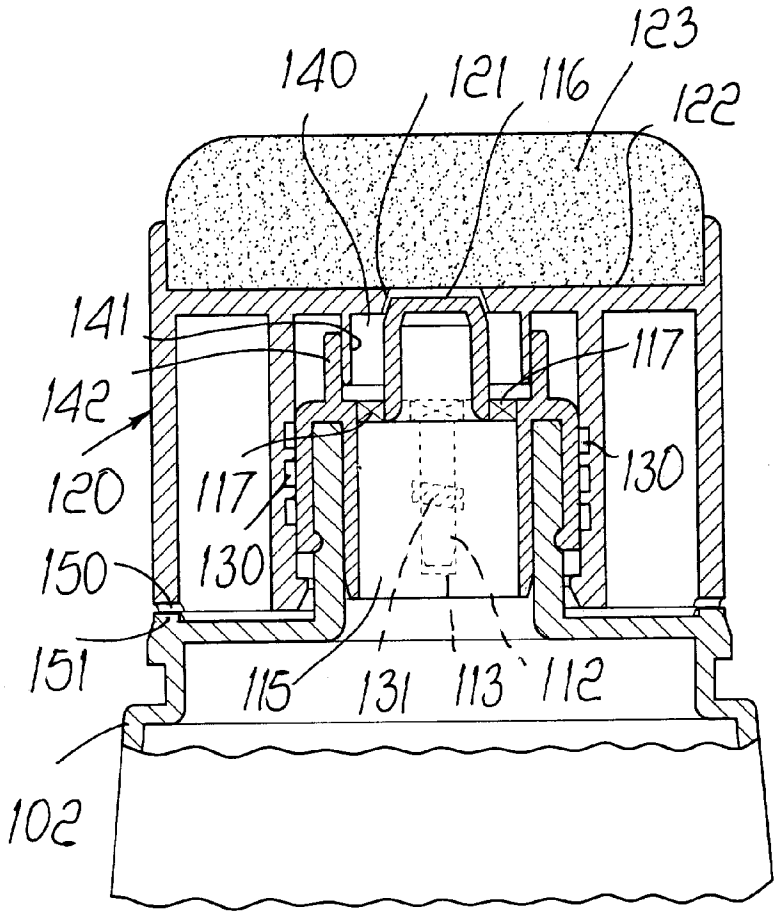
FIG. 3 is a sectional view of the container-applicator in the open position.

With reference to the figures, the container-applicator for fluid products, particularly for cosmetic and pharmaceutical use, generally designated by the reference numeral 101, has a container body 102 that forms a mouth 103 in which an applicator, generally designated by the reference numeral 110, is placed.

The applicator has a duct 111, which is fitted over the mouth 103 and is provided with a pair of ribs 112 that run parallel to the axis and are arranged diametrically. The ribs 112 enter seats 113 that are formed in the mouth 103 and in practice are designed to prevent the rotation of the duct 111.

The duct 111 has an inner side wall 115, which has in an upward region an axial protrusion 116 that engages a valve element, which in practice is formed by a cap-like body 120, which has an opening 121 provided at a recess 122, in which a spongy-matrix body 123 is accommodated.

The cap-like body 120 surrounds the duct 111 and is provided with a female thread 130 that engages teeth 131, which are provided on the outer surface of the duct 111 and in practice form a male thread.

The axial protrusion 116 is supported by spoke-like elements 117, which delimit in practice passage openings 118 for the passage of the fluid product into a chamber 140 that is formed between an internal tang 141 that protrudes from the cap-like body and an external tang 142 that protrudes on the duct 111 around the protrusion 116.

Figure 2:
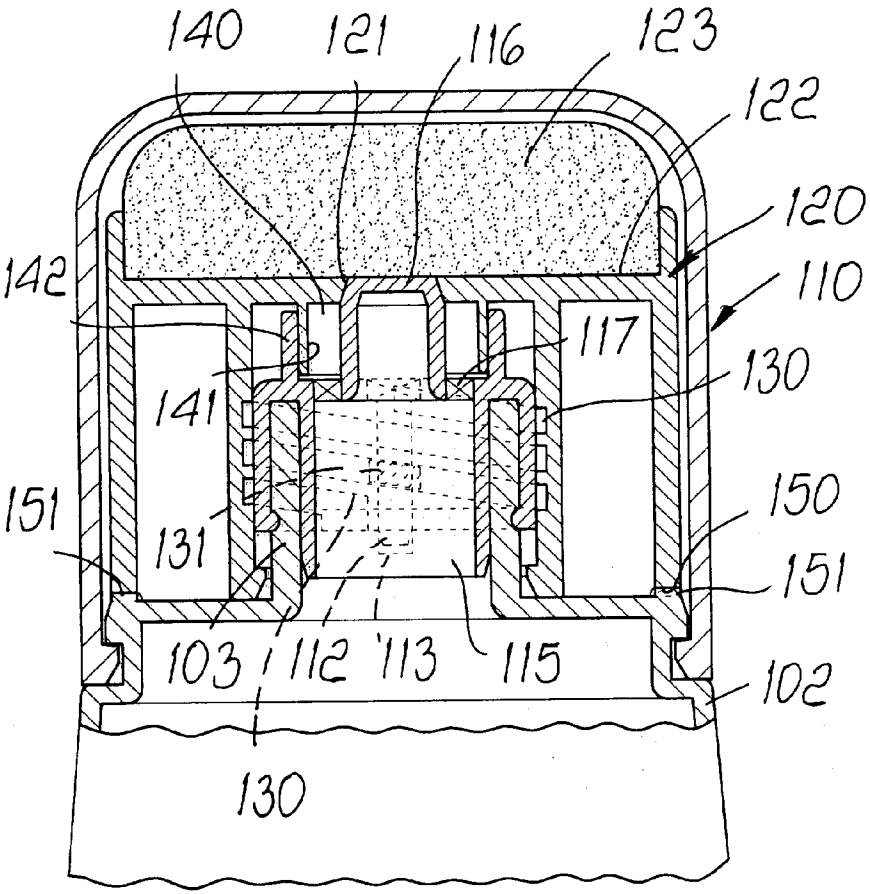
FIG. 2 is a sectional view of the container-applicator in the closed position.
Figure 5:
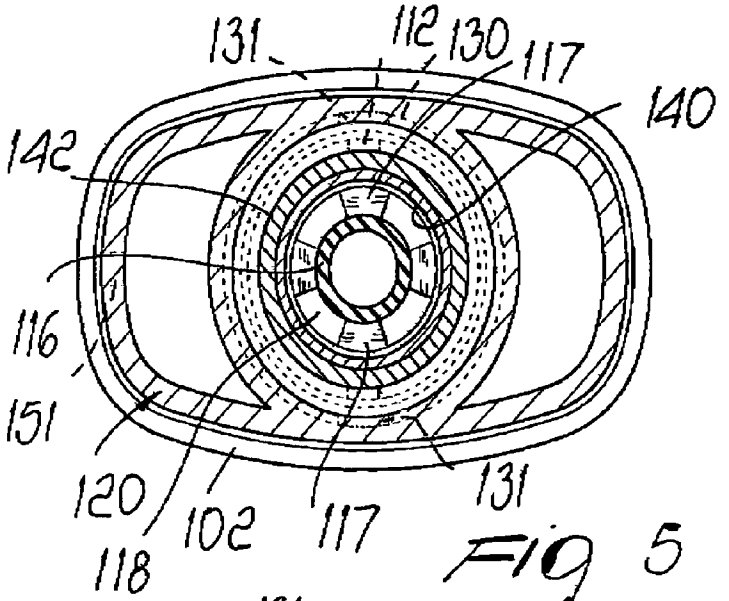
FIG. 5 is a sectional view, taken along the line V—V of FIG. 4.
Figure 6:
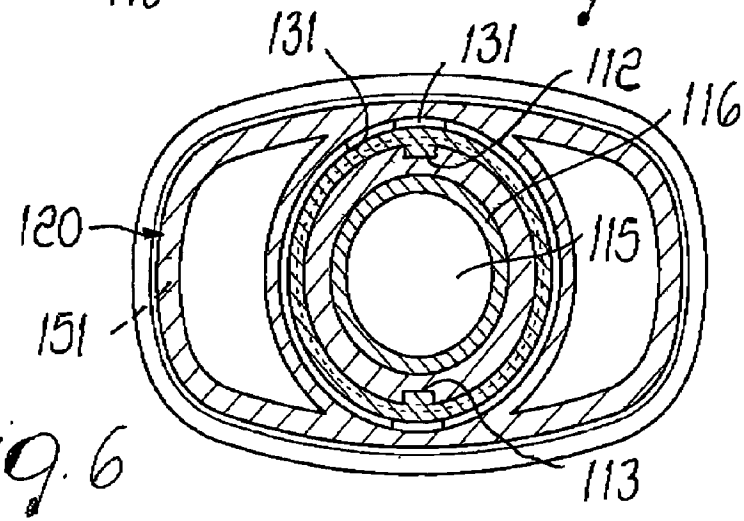
FIG. 6 is a sectional view, taken along the line VI—VI of FIG. 4.
Figure 4:
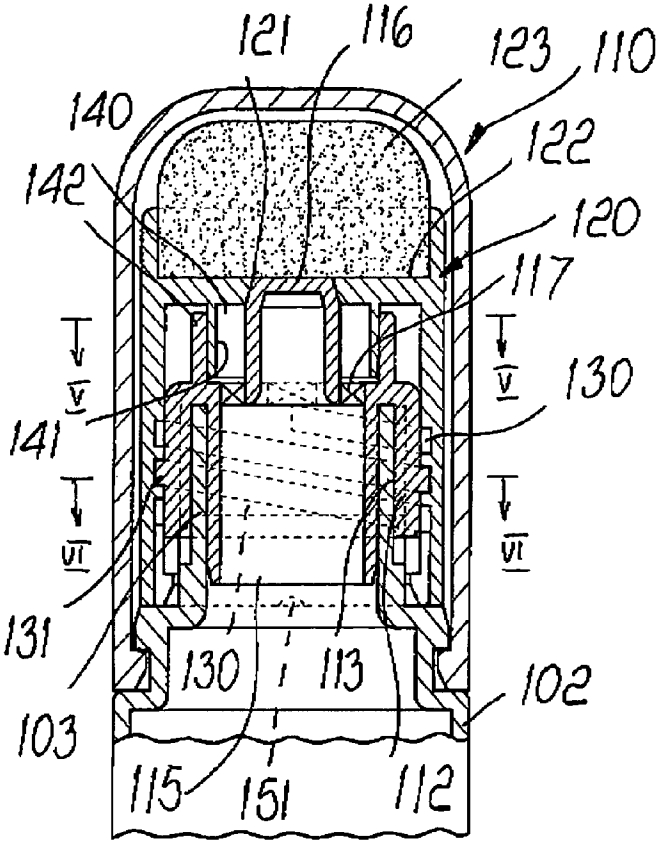
FIG. 4 is a transverse sectional view of the container-applicator.

The chamber 140 is connected to the opening 121, which is in turn controlled by the protrusion 116, which in the closed position, as shown in FIG. 2, enters the opening 121, maintaining the seal.

To open the opening, it is sufficient to turn the cap-like body 120, obtaining, by way of the coupling between the female thread and the male thread, an axial translational motion thereof, with a consequent spacing of the protrusion 116 from the opening 121 and the possibility to transfer the fluid from the chamber 140 toward the spongy-matrix body 123.

To perform closure, it is sufficient to turn the cap-like body, obviously in the opposite direction. The coupling between the tang 141 and the tang 142, which is substantially of the telescopic type, allows to provide in practice a closure toward the outside of the chamber 140, preventing losses of fluid and any dirtying.

Advantageously, the transition from the open position to the closed position is achieved by way of a 180° rotation of the cap-like body, which is preferably substantially oval and is provided with diametrical recesses 150 that engage, in the closure position, diametrical notches 151 formed correspondingly in the container body 102.

From the above description it is evident that the invention achieves the intended aim and objects, and in particular the fact is stressed that with the arrangement described above, the passage of the fluid into the matrix body can be obtained by turning the cap in order to open the opening 121, and by compressing the container body 102 it is possible to adjust easily at will the amount of fluid product introduced in the spongy-matrix body for dispensing.

The invention thus conceived is susceptible of numerous modifications and variations, all of which are within the scope of the appended claims.

All the details may further be replaced with other technically equivalent elements.

In practice, the materials used, as well as the contingent shapes and dimensions, may be any according to requirements.

The disclosures in Italian Patent Application No. MI2002A002143 from which this application claims priority are incorporated herein by reference.

What is claimed is:

1. A container-applicator for fluid products, particularly for cosmetic and pharmaceutical use, comprising, at a mouth of a container, an applicator provided with a spongy-matrix body that is arranged proximate to an opening controlled by a valve element that can be operated from the outside of the container body, wherein said valve element comprises only two elements, a cap-like body that can be actuated rotationally in order to pass from a closed lowered position to an open lifted position of said opening and/or vice versa, and a duct that can be coupled to said mouth and adapted to be engaged by said valve element, said cap-like body directly supporting said spongy-matrix body.

2. The container-applicator for fluid products according to claim 1, wherein said duct that can be coupled to said mouth is provided with two ribs that protrude substantially parallel to the axis and can engage in seats formed in said mouth in order to prevent the rotation of said duct, said duct forming, in an upward region, an axial protrusion that can engage said valve element.

3. The container-applicator for fluid products according to claim 1, wherein said cap-like body forms said opening at a recess in which said spongy-matrix body is accommodated.

4. The container-applicator for fluid products according to claim 2, wherein said cap-like body is provided with a female thread that can engage teeth, which are formed by said duct and provide a male thread for a translational motion of said cap-like body with respect to said duct when said cap-like body rotates.

5. The container-applicator for fluid products according to claim 2, wherein said duct, in cooperation with said cap-like body, forms a chamber that surrounds said axial protrusion and is formed between an inner tang that lies between said cap-like body and an outer tang that protrudes from said duct.

6. The container-applicator for fluid products according to claim 1, wherein passage from the open position to the closed position and/or vice versa is achieved with a 180° rotation of said cap-like body.

7. The container-applicator for fluid products according to claim 1, further comprising means for positioning said cap-Like body in the closed position.

8. The container-applicator for fluid products according to claim 7, wherein said positioning means are constituted by diametrical recesses which are formed in said cap-like body and can engage, in the closed position, diametrical notches formed on the container body.

* * * * *